US007399936B2

(12) United States Patent
Hurrle

(10) Patent No.: US 7,399,936 B2
(45) Date of Patent: Jul. 15, 2008

(54) OPERATING CONFIGURATION FOR A HOUSEHOLD APPLIANCE, OPERATING ELEMENT AND HOUSEHOLD APPLIANCE

(75) Inventor: Frank Hurrle, Gaggenau (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/888,723

(22) Filed: Jul. 8, 2004

(65) Prior Publication Data

US 2005/0067268 A1 Mar. 31, 2005

Related U.S. Application Data

(63) Continuation of application No. PCT/EP03/00071, filed on Jan. 7, 2003.

(30) Foreign Application Priority Data

Jan. 8, 2002 (DE) ..... 02 360 013

(51) Int. Cl.
*H01H 9/00* (2006.01)

(52) U.S. Cl. ..... 200/313; 200/310; 362/23

(58) Field of Classification Search ..... 200/4, 200/310–315, 5 R, 18; 362/23–29
See application file for complete search history.

(56) References Cited

U.S. PATENT DOCUMENTS

| | | | | | |
|---|---|---|---|---|---|
| 3,220,001 | A | | 11/1965 | Hallerberg | |
| 4,583,151 | A | * | 4/1986 | Nagel | 362/29 |
| 4,667,073 | A | * | 5/1987 | Osika | 200/317 |
| 4,758,724 | A | | 7/1988 | Osika | |
| 4,994,641 | A | | 2/1991 | Schiebelhuth | |
| 5,280,145 | A | * | 1/1994 | Mosier et al. | 200/313 |
| 5,336,859 | A | | 8/1994 | Wojtanek et al. | |
| 5,454,448 | A | * | 10/1995 | Bittar et al. | 187/395 |
| 5,464,955 | A | * | 11/1995 | Cole | 200/317 |
| 5,507,067 | A | * | 4/1996 | Hoekstra et al. | 15/319 |
| 5,638,060 | A | * | 6/1997 | Kataoka et al. | 341/20 |
| 5,651,450 | A | * | 7/1997 | Priesemuth | 200/314 |
| 5,698,826 | A | * | 12/1997 | Cracraft et al. | 200/5 A |
| 5,861,589 | A | * | 1/1999 | Sato et al. | 200/5 R |
| 5,945,647 | A | * | 8/1999 | Hoskins | 200/18 |
| 6,013,885 | A | * | 1/2000 | Kowalczyk | 200/315 |
| 6,153,837 | A | * | 11/2000 | Garcia et al. | 200/18 |
| 6,207,913 | B1 | * | 3/2001 | Nakajima et al. | 200/314 |
| 6,224,221 | B1 | * | 5/2001 | Glienicke | 362/23 |
| 6,348,772 | B1 | * | 2/2002 | May | 318/430 |
| 6,420,667 | B1 | * | 7/2002 | Miwa et al. | 200/4 |
| 6,531,669 | B1 | * | 3/2003 | Miller et al. | 200/313 |
| 6,531,952 | B1 | * | 3/2003 | Meyer et al. | 338/172 |
| 6,558,013 | B2 | * | 5/2003 | Tholin et al. | 362/29 |
| 6,590,174 | B2 | * | 7/2003 | Zysnarski et al. | 200/310 |

FOREIGN PATENT DOCUMENTS

| | | |
|---|---|---|
| DE | 42 04 499 A1 | 8/1993 |
| DE | 195 39 081 A1 | 4/1997 |
| EP | 0 353 343 A2 | 2/1990 |

* cited by examiner

*Primary Examiner*—K. Richard Lee
(74) *Attorney, Agent, or Firm*—Russell W. Warnock; James E. Howard

(57) ABSTRACT

An operating device for a household appliance is formed with an aperture, and an operating element is guided through an assembly hole in the aperture. A plurality of light sources in the operating element, indicate the operational state of the household appliance. The information content is increased with the plurality of light sources that indicate at least two mutually different operational states of the household appliance.

18 Claims, 2 Drawing Sheets

Fig. 1
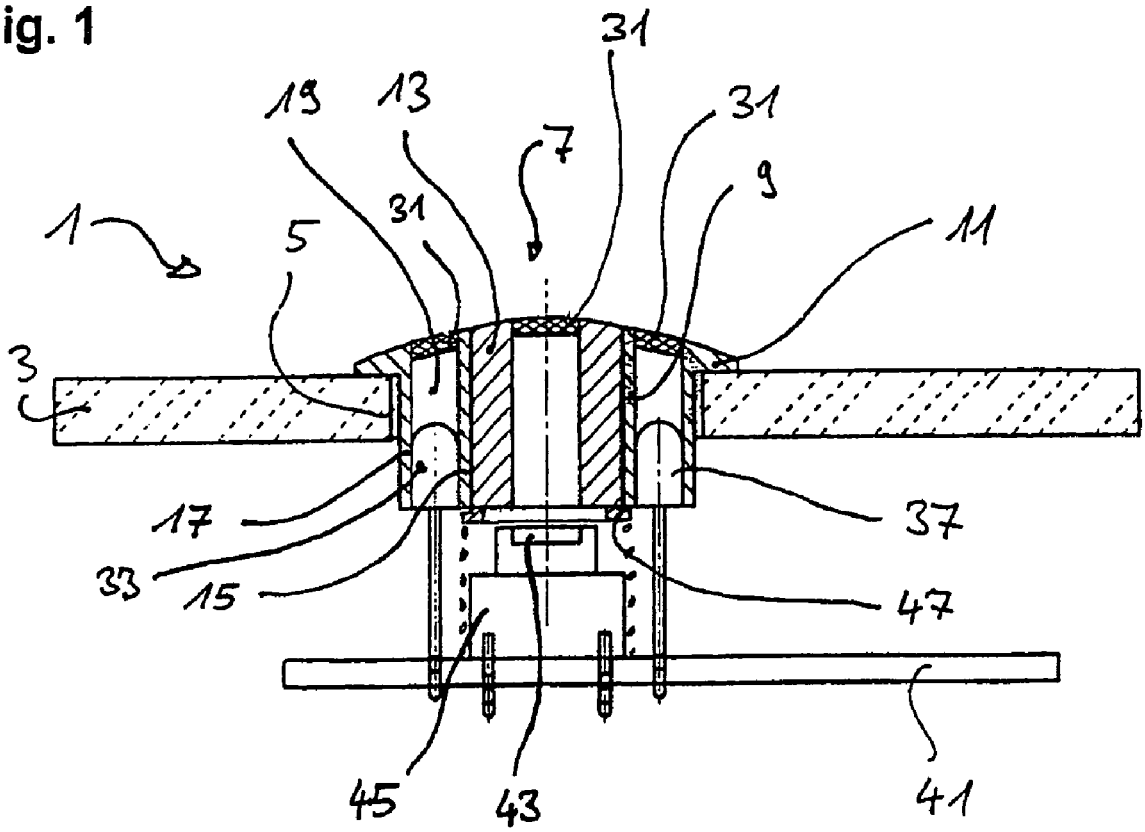
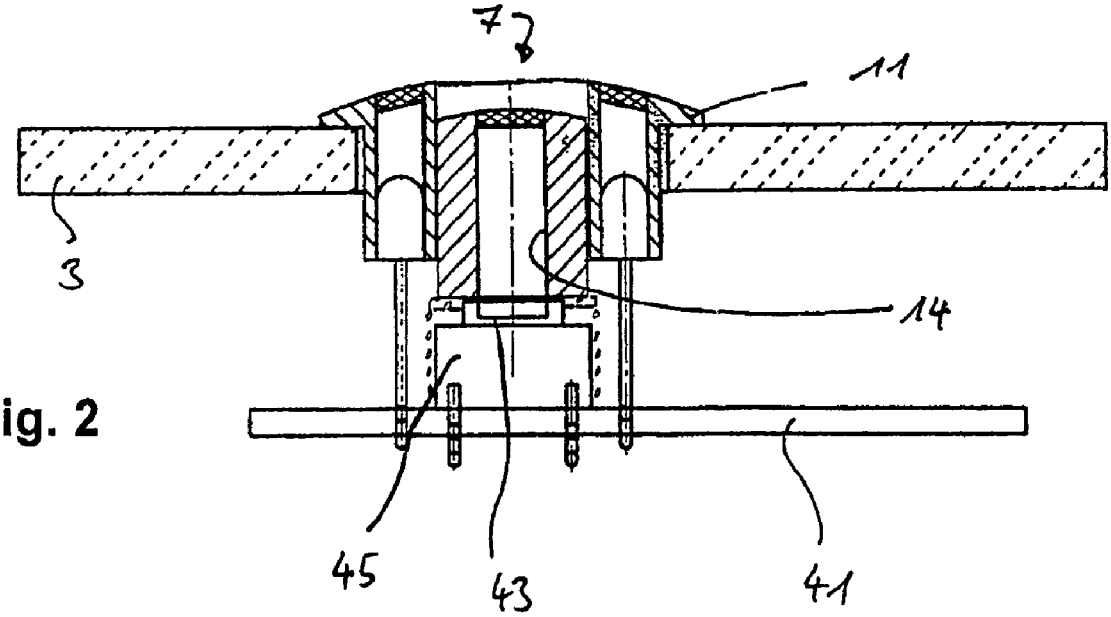
Fig. 2

OPERATING CONFIGURATION FOR A HOUSEHOLD APPLIANCE, OPERATING ELEMENT AND HOUSEHOLD APPLIANCE

CROSS-REFERENCE TO RELATED APPLICATION

This application is a continuation, under 35 U.S.C. § 120, of copending international application No. PCT/EP03/00071, filed Jan. 7, 2003, which designated the United States; this application also claims the priority, under 35 U.S.C. § 119, of European patent application No. 02 360 013.3, filed Jan. 8, 2002; the prior applications are herewith incorporated by reference in their entirety.

BACKGROUND OF THE INVENTION

FIELD OF THE INVENTION

The present invention relates to a household appliance having an operating element and an operating configuration for the electrical household appliance, the latter having an operating panel and the operating element, which is guided through an installation opening of the operating panel, in which operating element a light source indicates an operating state of the household appliance.

German published patent application DE 195 39 081 discloses an operating module for electrical household appliances. The operating module has a rotary operating knob, of which the switching positions are shown by an LED indicator. The light source of the LED indicator is formed by a light bulb which is arranged on a holder that is fastened on a printed circuit board and is wired up electrically. The light bulb is located in a translucent portion of the rotary knob, by way of which operation of the cooking appliance is generally indicated.

SUMMARY OF THE INVENTION

It is accordingly an object of the invention to provide a household appliance, an operating element, and an operating configuration for the household appliance in which a multiplicity of indicators are provided in the operating element and which overcomes the above-mentioned disadvantages of the heretofore-known devices and methods of this general type.

With the foregoing and other objects in view there is provided, in accordance with the invention, a switching configuration for a household appliance having an operating panel, comprising:

an operating element mounted to extend through an installation opening of the operating panel;

a multiplicity of light sources in the operating element for indicating an operating state of the household appliance, the light sources being configured to indicate at least two mutually different operating states of the household appliance.

In other words, the objects of the invention are achieved with the operating element that has a multiplicity of light sources, and the light sources indicate at least two different operating states of the household appliance. It is thus possible for a multiplicity of indicators for different operating states to be integrated in the operating element. For example, a fault indicator, an overheating indicator and a childproofing indicator can be integrated in the operating element and need not be secured with high outlay in the operating panel. The number of additional bores in the operating panel in which indicating elements for the abovementioned operating states are inserted can be reduced according to the invention.

According to an advantageous configuration, the light sources can be activated simultaneously by an electrical control device, with the result that the different operating states can be indicated simultaneously. The operating states can thus be indicated independently of one another in the operating element.

In accordance with an added feature of the invention, each of the indicated operating states may be assigned at least one light source. Each light source can thus be adapted specifically for indicating a certain operating state. It is thus easier for an operator to distinguish between the operating states indicated.

The ease of distinguishing between the different operating-state indicators is further increased as follows: according to one configuration, the light source associated with one operating state can light up in a color which differs from the color of the other light sources. As an alternative, the light source associated with one operating state can light up at a flashing frequency which differs from that of the other light sources.

The operating element may have a guide part, which is secured on the operating panel, and an operating knob, which is mounted in an adjustable manner in the guide part. In one embodiment of the invention, the guide part may contain a multiplicity of light-guiding lines which are separated from one another via partition walls. The light sources may be arranged in the light-guiding lines.

In a particularly straightforward configuration of the invention, the guide part may be produced from a transparent material or from a translucent material. In the case of light sources of different colors, it is thus possible for the guide part to light up in the color of the activated light source. In this case, each color is assigned one operating state.

In accordance with an alternative embodiment of the invention, the operating element may have a multiplicity of front light-exit zones which are essentially separated from one another. In this case, each of the light sources is assigned at least to one light-exit zone. The light-exit zones which are essentially separated from one another advantageously prevent the light sources from influencing one another. In a further configuration of the invention, the operating element may have a multiplicity of light-guiding lines which connect each of the light sources to one of the light-exit zones. Such light-guiding lines are designed, for example, as hollow channels or as light conductors made of a transparent material.

In a particularly advantageous configuration, the operating element may have a guide part, which is retained in a stationary manner on the operating panel, and an operating knob, which is mounted in a displaceable manner in the guide part. In this case, the operating knob is assigned a light source which is used to indicate an operating state which can be adjusted by the operating knob. In the case of the operating knob being actuated, the operator can thus assign the light-source indicator to the operating knob in a defined manner.

In an advantageous development, the abovementioned operating knob may be designed as a push-down knob which is mounted in a displaceable manner in the guide part. The push-down knob may, in turn, be a switch for switching the household appliance on and off.

Other features which are considered as characteristic for the invention are set forth in the appended claims.

Although the invention is illustrated and described herein as embodied in an operating configuration for a household appliance, operating element and household appliance, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIGS. 1 and 2 each shows an enlarged sectional illustration from the side of an operating configuration for a household appliance according to a first exemplary embodiment of the invention;

DESCRIPTION OF THE PREFERRED EMBODIMENTS

Figure 3:
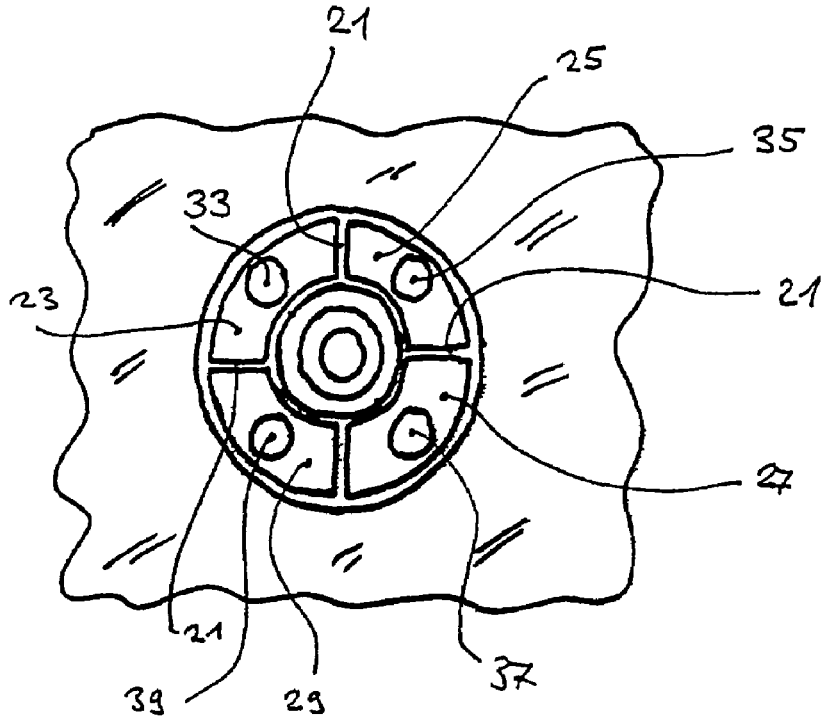
FIG. 3 is a plan view of the operating configuration according to FIG. 1.

Referring now to the figures of the drawing in detail and first, particularly, to FIG. 1 thereof, there is shown an operating configuration 1 according to the first exemplary embodiment. The operating configuration has an operating panel 3. An operating element 7, constituted by a frame structure and light sources, is inserted in an installation opening 5 of the operating panel 3. Via the operating configuration 1, for example, a gas supply to a burner of a gas stove is interrupted or released. According to FIG. 1, the operating configuration 1 is disposed in a hob panel or stove plate made of glass-ceramic material. The hob panel thus corresponds to the operating panel 3. The operating element 7 has a stationary guide part 9, which is inserted in the installation opening 5. The guide part 9 is supported on a top front side of the glass-ceramic panel 3. A retaining flange 11 serves as an abutment for the guide part 9. The retaining flange 11 is located on the periphery of the installation opening 5 without leaving any gaps. The retaining flange 11 of the guide part 9 is fixed to the glass-ceramic panel 3 via a silicone-adhesive bond. A push-down knob 13 is mounted in an axially displaceable manner in the guide part 9. The push-down knob 13 is configured as a hollow cylinder which can be displaced along an inner wall 15 of the guide part 9. The cylindrical inner wall 15 runs concentrically in relation to a cylindrical outer wall 17 of the guide part. A concentric annular gap 19 is formed between the inner wall 15 and the outer wall 17.

With a view to FIG. 3, the annular gap 19 is divided into separate ring segments 23 to 29 via radial crosspieces 21. The front openings of the ring segments and of the hollow cylinder 13 are closed by way of caps 29 made of transparent material. LED components 33 to 39 are arranged, as light sources, in the opposite openings of the ring segments 23 to 29. The LED component 33 to 39 are connected to a printed circuit board 41 via lines and are wired up electrically to a non-illustrated electrical control device. A further LED component 43 is provided at the opening which is located opposite the front opening of the hollow cylinder 13. The further LED component 43 is provided in a contact switch 45. The contact switch 45 can be actuated by way of the push-down knob 13.

FIG. 1 shows the push-down knob 13 in its first end position. In the first end position, stops 47 of the push-down knob 13 are prestressed against a bottom end side of the guide part 9 with the aid of a restoring spring 49. The restoring spring 49 is inserted between the stops 47 and the printed circuit board 41. The top front side of the push-down knob 13 here terminates flush with the front side of the guide part 9. FIG. 2 illustrates the push-down knob 13 in its second end position. In this second end position, the push-down knob 13 has been displaced axially by an operator counter to the spring force of the restoring spring 49. In this case, the stops 47—as is shown in FIG. 2—strike against a shoulder 51 of the switch 45.

Once the contact switch 45 has been actuated by means of the push-down knob 13, the electrical control device switches on the LED component 43. The light of the LED component 43 is guided, via the interior of the push-down knob 13, to the front end side of the hollow cylinder 13 and illuminates the cap 29. The operator can thus see that the gas supply to the gas hob has been released. Each of the further four LED components 33-39 is assigned a cooking point of the gas hob via the electrical control device. The LED components 33-39 are activated by the electrical control device as soon as the corresponding cooking points are brought into operation. For example, one of the LED components lights up permanently during operation of the associated cooking point. If the flame at this associated cooking point is extinguished, a flashing light is produced by means of the electrical control device at the LED component 33.

Figure 4:
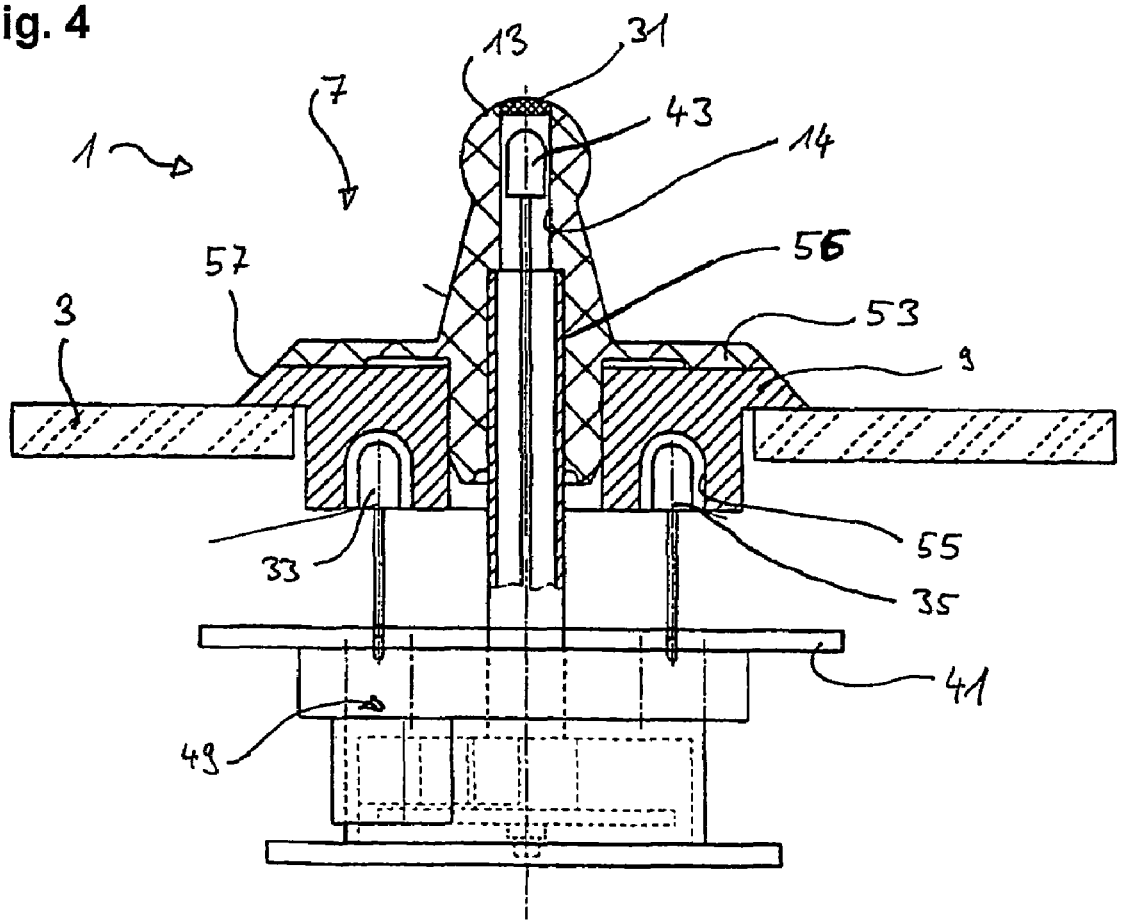
FIG. 4 is a sectional illustration from the side, similar to the view of FIGS. 1 and 2, of a second exemplary embodiment of the invention.

FIG. 4 shows an operating configuration 1 according to the second exemplary embodiment. In contrast with the first exemplary embodiment, the operating knob 13 is configured as a rotary knob which is produced from a non-translucent material. The rotary knob 13 is used to adjust, for example, a quantity of gas to a gas burner of the above-mentioned gas stove. As explained with reference to FIG. 1, it is also the case with FIG. 4 that the operating element 7 is disposed in the glass-ceramic panel 3 of the gas stove. The rotary knob 13 of the operating element 7 is rotatably mounted within the cylindrical inner wall 15 of the guide part 9 of the operating element 7. Furthermore, the rotary knob 13 has an encircling collar 53 which is supported on the front side of the guide part 9. In order to transmit an adjusting movement of the rotary knob 13 to the gas burner, the rotary knob 13 is fastened on a tubular switching stem 56 of a switching device 49 such that it can be pulled away. A line of the LED component 43, which is arranged in a cavity of the rotary knob 13, is guided through the tubular switching stem 5.

The guide part 9 is configured as an illuminatable body produced from a transparent material. On its underside, the illuminatable body 9 is formed with cutouts 55 in which the LED components 33 and 35 are inserted. According to the present exemplary embodiment, the LED component 33 lights up in a first color and the LED component 35 lights up in a different, second color. An encircling peripheral side 57 of the retaining flange 11 serves, according to FIG. 4, as a lateral light-exit zone of the illuminatable body 9. This zone is provided, in FIG. 4, between the non-translucent collar 53 and the glass-ceramic panel 3.

If, during the operation of a cooking point assigned to the operating configuration 1, the LED component 33 is activated by the electrical control device, then the peripheral side 57 of the illuminatable body 9 lights up in the first color. Overheating of the cooking point, for example, can thus be indicated to the operator. If the LED component 35 is activated by the electrical control device, the peripheral side 57 of the illuminatable body 9 lights up in the second color. This can indicate to the operator, for example, that a childproofing mechanism has been switched on. There is thus no need for any additional bores in the glass-ceramic panel 3 for the insertion of a separate childproofing and/or overheating indicator.

As an alternative, the illuminatable body 9—corresponding to the first exemplary embodiment—is subdivided by crosspieces into individual ring segments which are each assigned one operating state.

I claim:

1. An operating configuration for a household appliance having an operating panel, comprising:

an operating element, the operating element being manipulable to effect an operation concerning a household appliance and the operating element having an encroachment portion that extends through an installation opening of the operating panel;

a plurality of light sources in said operating element for indicating an operating state of the household appliance, said light sources being configured to emit energy providing a visual indication of indicate at least two mutually different operating states of the household appliance and at least one of the energy emitted by each light source and the light source itself respectively passing through or extending into the encroachment portion of the operating element that extends through the installation opening.

2. The operating configuration according to claim 1, wherein said light sources are connected to be activated simultaneously, and to simultaneously indicate the different operating states.

3. The operating configuration according to claim 1, wherein a respective said light source assigned to one operating state is configured to light up in a color different from a color of another light source.

4. The operating configuration according to claim 1, wherein the light source assigned to one operating state lights up at a flashing frequency which differs from that of the other light sources.

5. The operating configuration according to claim 1, wherein the operating configuration is configured to operate functions of the household appliance.

6. An operating element for an operating configuration in a household appliance, the household appliance having an operating panel, the operating element comprising:

a frame structure configured to be mounted in an installation opening of the operating panel;

a multiplicity of light sources in said frame structure for indicating an operating state of the household appliance, said light sources being configured to emit energy providing a visual indication of indicate at least two mutually different operating states of the household appliance and at least one of the energy emitted by each light source and the light source itself respectively passing through or extending into the frame structure of the operating element that extends through the installation opening.

7. An operating configuration for a household appliance having an operating panel, comprising:

an operating element, the operating element being manipulable to effect an operation concerning a household appliance and the operating element having an encroachment portion that extends through an installation opening of the operating panel;

a plurality of light sources in said operating element for indicating an operating state of the household appliance, said light sources being configured to emit energy providing a visual indication of indicate at least two mutually different operating states of the household appliance and at least one of the energy emitted by each light source and the light source itself respectively passing through or extending into the encroachment portion of the operating element that extends through the installation opening;

a guide part included with said operating element and secured to the operating panel; and an operating knob adjustably mounted to said guide part.

8. The operating configuration according to claim 7, wherein a multiplicity of light-guiding lines are formed in said guide part, and said guide part contains partition walls separating said light-guiding lines.

9. The operating configuration according to claim 8, wherein said light sources are disposed within said light-guiding lines.

10. The operating configuration according to claim 7, wherein said guide part is formed of a transparent material.

11. The operating configuration according to claim 7, wherein said guide part is formed of a translucent material.

12. The operating configuration according to claim 7, wherein said operating knob is assigned a respective said light source to indicate an operating state that is adjustable by said operating knob.

13. The operating configuration according to claim 7, wherein said operating knob is a push-down knob displaceably mounted in said guide part and/or a rotary knob.

14. The operating configuration according to claim 7, wherein said operating knob is a rotary push-down knob displaceably mounted in said guide part.

15. The operating configuration according to claim 7, wherein said operating knob is a rotary knob rotatably mounted in said guide part.

16. An operating configuration for a household appliance having an operating panel, comprising:

an operating element, the operating element being manipulable to effect an operation concerning a household appliance and the operating element having an encroachment portion that extends through an installation opening of the operating panel; and a plurality of light sources in said operating element for indicating an operating state of the household appliance, said light sources being configured to emit energy providing a visual indication of indicate at least two mutually different operating states of the household appliance and at least one of the energy emitted by each light source and the light source itself respectively passing through or extending into the encroachment portion of the operating element that extends through the installation opening and a respective one of said light sources being illuminable to indicate a selected one of the presence and the non-presence of a respective one operating state of the household appliance, whereby the non-illumination of the respective one light source is an indication of the other of the presence and the non-presence of the respective one operating state of the household appliance, and another respective one of said light sources being illuminable to indicate a selected one of the presence and the non-presence of another respective operating state of the household appliance that is a different operating state of the household appliance than the respective one operating state of the household appliance, whereby the non-illumination of the another respective light source is an indication of the other of the presence and the non-presence of the another respective operating state of the household appliance, and the operating configuration controlling the illumination and non-illumination conditions of the one respective light source and the another respective light source such that, during a period of time in which the respective one light source is in a selected one of its illuminated condition and its non-illuminated condition to thereby indicate the corresponding presence or non-presence of the respective one operating state of the household appliance and there is a change in the status of the another respective operating state of the household appliance between its presence status and its non-presence status, the another respective light source is correspondingly changed between its illuminated condition and its non-illuminated condition and thereby indicates the new respective presence or non-presence status of the another respective operating state of the household appliance.

17. The operating configuration according to claim 16, wherein the household appliance is formed of at least two burners each for heating a cooking utensil disposed thereabove, the operating configuration controls the one respective light source to be illuminated to thereby indicate an operating state of the household appliance in which one of the at least two burners has been brought into operation, and the operating configuration controls the another respective light source to change from its non-illuminated condition to its illuminated condition to thereby indicate the presence of an operating state of the household appliance that an energization source for energizing the burners has been made available to the burners.

18. The operating configuration according to claim 17, wherein the household appliance is formed of at least two gas burners and the operating configuration controls the another respective light source to change from its non-illuminated condition to its illuminated condition to thereby indicate the presence of an operating state of the household appliance that a gas energization source for energizing the burners has been made available to the burners.

* * * * *